United States Patent [19]

Strauss

[11] Patent Number: 4,747,942

[45] Date of Patent: May 31, 1988

[54] PULSE GENERATOR FOR AN AIR PULSED JIGGING MACHINE

[75] Inventor: Werner Strauss, Bochum, Fed. Rep. of Germany

[73] Assignee: Klöckner-Humboldt-Deutz Aktiengesellschaft, Fed. Rep. of Germany

[21] Appl. No.: 885,021

[22] Filed: Jul. 14, 1986

[30] Foreign Application Priority Data

Jul. 12, 1985 [DE] Fed. Rep. of Germany ..... 3524958

[51] Int. Cl.[4] ..... B03B 4/00; B03B 5/20

[52] U.S. Cl. ..... 209/455; 137/595; 137/596; 137/614.16; 209/502; 251/308

[58] Field of Search ..... 137/625.21, 595, 614.16, 137/614.17, 625.18, 625.19, 596; 209/457, 500, 455, 502, 456; 251/308

[56] References Cited

U.S. PATENT DOCUMENTS

| | | | |
|---|---|---|---|
| 2,027,597 | 1/1936 | Lide | 209/455 |
| 2,052,431 | 8/1936 | Wade | 209/500 X |
| 2,169,544 | 8/1939 | Vissac | 209/455 |
| 4,019,981 | 4/1977 | Stern et al. | 209/500 X |
| 4,312,381 | 1/1982 | Ratner | 137/595 X |
| 4,373,542 | 2/1983 | Scaramucci | 251/308 X |
| 4,485,010 | 11/1984 | Strauss et al. | 251/59 X |
| 4,508,620 | 4/1985 | Najima et al. | 209/500 |

FOREIGN PATENT DOCUMENTS

| | | | |
|---|---|---|---|
| 291915 | 12/1913 | Fed. Rep. of Germany | 137/614.16 |
| 432615 | 12/1911 | France | 137/614.17 |
| 2385019 | 11/1978 | France | 137/625.21 |

*Primary Examiner*—Robert G. Nilson
*Assistant Examiner*—Stephen M. Hepperle
*Attorney, Agent, or Firm*—Hill, Van Santen, Steadman & Simpson

[57] ABSTRACT

A wet jig mechanism for handling coal or other minerals wherein a container receives a slurry of water and coal and the water is pulsed by delivering an alternate charge of compressed air beneath the surface of the water and alternately venting the area beneath the surface with the alternate pulsing and venting controlled by a pulsing valve having valve chambers with one chamber having ports connected beneath the surface of the container and to a source of compressed air in the other chamber connected beneath the surface of the liquid in the container and vented to atmosphere with the ports being controlled by butterfly valve plates in each chamber mounted on a common shaft and the chambers having liners or bushings rotatable to control the ports and time and duration of opening of the ports.

8 Claims, 2 Drawing Sheets

PULSE GENERATOR FOR AN AIR PULSED JIGGING MACHINE

BACKGROUND OF THE INVENTION

The present invention relates to improvements in mechanisms for the preparation of mineral mixtures, particularly of a rough washed coal in a jig controlled by compressed air wherein the liquid mixture of the coal is given a pulsed motion by means of pulsations of compressed air. The invention particularly relates to an improved valve structure for controlling the air pulsations in connecting an opening beneath the surface of the container for the coal connected alternately to compressed air and to atmosphere.

In wet jigging machines for preparing coal or other minerals, a large container is provided through which a slurry of coal is flowed, and pulse openings open downwardly beneath the surface of the liquid in the container and the openings are supplied with air pulsations at a controlled frequency. In the control of these pulsations both for the supply of compressed air and the release of air to the atmosphere, various forms of valves have been employed. Valves frequently used employ slide mechanisms or disks or mushroom-type poppet valves. Examples of control mechanisms are shown and described in U.S. Pat. Nos. 4,019,981 and 4,485,010.

The present invention relates to a combination embodying an improved mechanism wherein the compressed air from an air dome and the venting of the air into the outside atmosphere for the jig is controlled and where the timing can be controlled to conveniently regulate the duration of opening as well as the time of occurrence of opening.

In a jigging machine the space available for the control is limited and thus the conduit cross-section for the pressurized air conduits and the conduits and the conduits vented to atmosphere is crucial. Also, the path of flow of the compressed air and the venting of air to atmosphere must be such that the timing of the airflow can be accurately controlled. That is, the control valve arrangement for the pulses must be such that there is an absence of throttling losses in pressure and timing in the passages and particularly in the valve structure.

An object of the present invention is to provide a pulse generator valve which is constructed to require a limited space and which has minimum flow losses both in the valve itself and the manner in which it can be connected to the airflow conduits or passages.

A further object of the invention is to provide an improved pulse control valve wherein the valve timing is very easily changed and regulated and wherein the duration of time of the valve opening can be readily controlled and wherein the opening time can be readily regulated and controlled.

In accordance with the objects, a feature of the invention is to provide a pulse control valve which employs butterfly valve plates mounted on a common shaft with compartments therein connecting to ports which extend parallel through the chambers for the conduction of pressurized air and the conduction of air from the jig to the atmosphere in a straight-through linear path. A reduction of flow losses in the valve is achieved in various ways. One way is that the construction and principles of the valve permit a relatively large conduit cross-section with no deflections of the airstream being required During a jigging machine cycle, both the conduit from the air dome to the air chamber beneath the liquid as well as that from the air chamber to the outside atmosphere, must be closed during at least half the cycle time. In the present valve employing a butterfly valve plate, the valve rotates in a correspondingly large cylindrical housing whereby the opening and closing times are defined as approximated by the area of the ports and opening in the cylindrical housing wall. As distinguished from previous rotary slide valve controls, a jigging cycle is already terminated after a revolution of 180°. A full cycle is repeated twice for each full rotation so that utilization of half the rotational speed does not detract from the steepness of the reaction of airflow to the valve operation. The butterfly valve plate thus releases twice during each revolution. The arrangement permits the provision of a cross-sectional area of the ports and conduits leading thereto to be larger than possible with devices heretofore available. This permits the maximum pressure in the air chamber, beneath the surface of the liquid to be reached sooner. This also permits the release to be reached sooner. Therefore, the pressure curve of the pressure within the chamber beneath the liquid surface which is approximately a trapezoidal curve, more greatly approximates a desired rectangular curve. The butterfly valve plate has a minimal flow inhibiting effect and requires a minimu of structural cross-sectional space which, of course, is less than that of a flat slide valve.

A further object of the invention is to provide a pulse control valve of fewer parts and of simpler construction than valves heretofore available such as that provided by a rotary piston type of valve.

In accordance with a preferred embodiment, the pressurized air admission conduits and the conduits for releasing air to atmosphere are not shifted relative to each other in an axial direction. As a result, the flow need not be deflected and the resistance to flow and thus the delay in pressurization and release is minimized.

In accordance with a preferred embodiment, the angle between the butterfly valve plate in the pressurized air conduit and the butterfly valve plate of the conduits for outside atmosphere is variable. The points in time for opening and closing can thus be varied and controlled.

As a further feature of a preferred embodiment of the invention, the cross-sectional area of the ports in the valve which communicate with the pressurized and release passages are variable by means of a lining or bushing within the valve. The characteristic can be independently varied both for the inflowing pressurized air as well as for the outflowing atmospheric air and the total opening can be varied as well as the time of beginning or ending of the flow. The characteristic of flow in each direction, that is, of pressurized air and of air release can be varied independently of one another.

In accordance with another feature of the invention, a butterfly valve plate operates within a cylindrical housing and a gap is provided between the edge of the valve plate and the housing wall. This permits a leakage flow on the order of magnitude of tenths of a millimeter of liters, but this does not recognizably detract from the operation of the pulsing valve. The gap, however, eliminates the need for lubrication, and eliminates wear and the need for frequent servicing or replacement.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
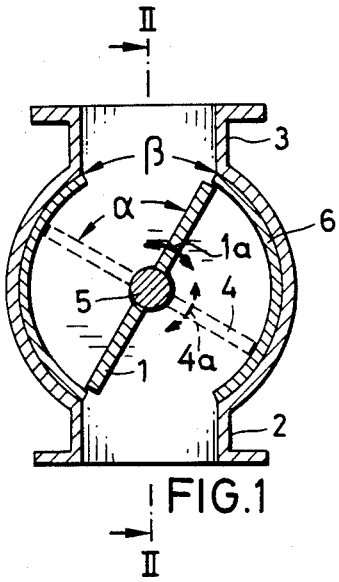
FIG. 1 is a cross-sectional view taken substantially along line I—I of FIG. 2.
Figure 2:
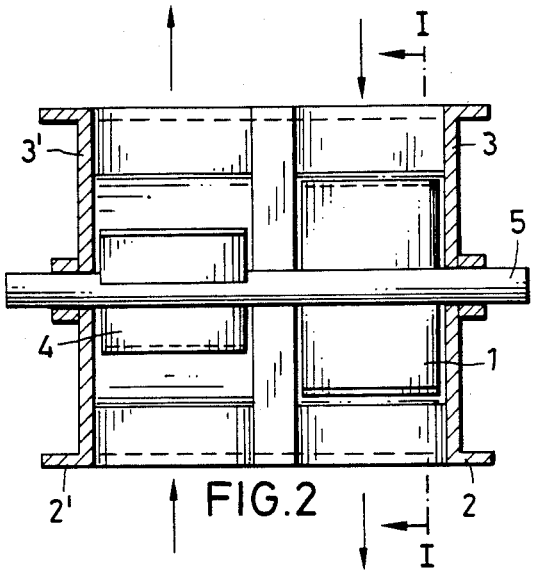
FIG. 2 is a vertical sectional view taken substantially along line II—II of FIG. 1 of the drawing.

FIGS. 1 and 2 illustrate a valve housing having a cylindrical body with end walls 3 and 3'. Within the cylindrical housing is a cylindrical chamber with a butterfly valve plate. The valve housing is arranged with a first chamber shown in FIG. 1 and shown to the right in FIG. 2 with a butterfly valve plate 1 therein.

The pulsating valve housing has a second chamber with a butterfly valve plate 4 therein shown to the left in FIG. 2. The first chamber is arranged for the passage of pressurized compressed air and the second chamber connected to release air to atmosphere.

The valve housing is provided for the first pressurized air chamber with first and second ports 2 and 3. Port 2 is arranged to be connected to an opening beneath the surface of liquid in the jigging container, and the port 3 is arranged to be connected to a pressure dome or source of pressurized air.

Figure 4:
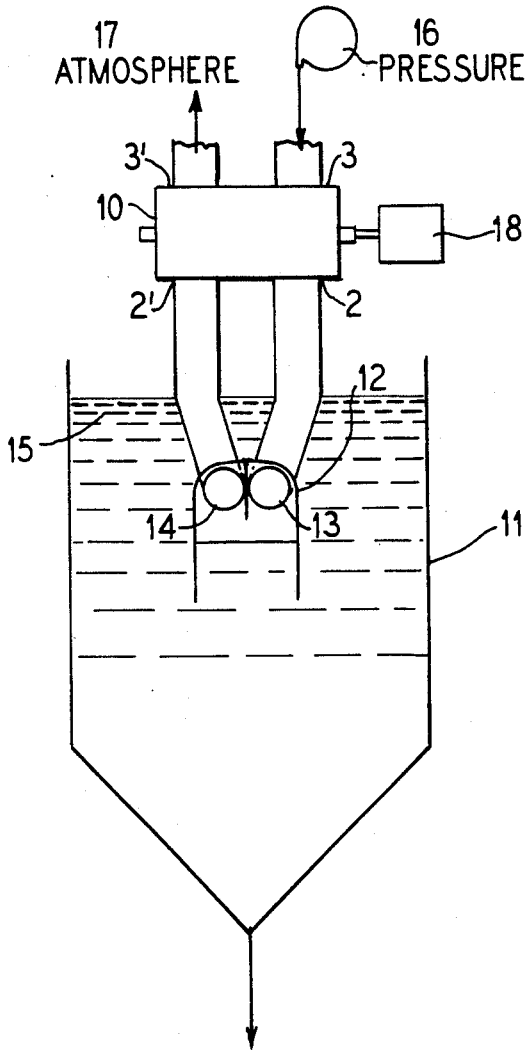
FIG. 4 is a schematic illustration of the jig assembly embodying the valve arrangement.

FIG. 4 illustrates the overall arrangement. The valve housing is shown at 10 and a jig container is shown at 11 with a liquid slurry 15 therein. Beneath the surface of the liquid is a downwardly facing cup-shaped inverted dome 12 and openings 13 and 14 are located beneath the dome for directing pulsating pressurized air beneath the surface of the liquid 15 and for venting the dome 12. Compressed pressurized air shown generally at 16 is connected to the port 3 in the valve 10, and port 3' is vented to atmosphere as indicated at 17. In a predetermined cycle, the pulsating valve 10 will operate to alternately direct pressurized air into the opening 13 and to subsequently vent air from the opening 14 to atmosphere.

As shown in FIGS. 1 and 2, the valve housing has the second valve chamber with the butterfly plate 4 therein. The plate 4 is positioned at an angle $\alpha$ relative to the plate 1. Both plates are mounted on a common shaft 5 rotatably supported in the housing. The shaft is driven in rotation by suitable timing and driving means 18 so that as the butterfly plates 1 and 4 rotate, they sequentially and alternately cause communication between ports 2 and 3 and between ports 2' and 3' respectively. That is, while the butterfly valve plate 1 clears the edges of the ports 2 and 3, direct pass-through communication is afforded through the valve chamber to direct pressurized air to the container. As the plate 1 continues to rotate, it blocks off the passage between the ports and the plate 4 then is in alignment with ports 2° and 3' to vent the opening beneath the surface of the liquid in the jig container.

As used herein, "rotate" and "rotation" mean a unidirectional movement through a full 360°, as opposed to oscillatory movement. The driving means 18 may be arranged to rotate the plates either clockwise or counter-clockwise, but during a jigging operation the plates are moved in only one rotational directional.

Each of the butterfly valve plates 1 and 4 are angularly adjustably mounted on the shaft 5 by suitable adjustments means shown schematically at 1*a* and 4*a*. For example, the butterfly plates may be locked in their adjusted position by a set screw threaded into a hub on the butterfly plate and frictionally engaging the shaft.

The angle between the butterfly valves 1 and 4 is shown at $\alpha$.

Within the housing is a liner or bushing 6 which is arcuately shaped to conform to the shape of the inside wall of the housing. When the bushing or liner 6 is in the position shown in FIG. 1, the opening corresponds in size and position to the ports 2 and 3. A similar bushing will be located in the second valve chamber. The bushing is locked in place but is rotationally adjustable so as to change the angle of the opening, angle $\beta$.

The inner surface of the liner 6 is essentially of the diameter of the width of the butterfly plate 1 but preferably there is a small gap between the edge of the plate and the inner surface of the liner 6. This gap is small so as to admit very little leakage of air past the edges of the plate but the provision of a gap is sufficient to prevent friction between the outer edges of the butterfly plate and the inner surface of the insert so that lubrication is not necessary.

Figure 3:
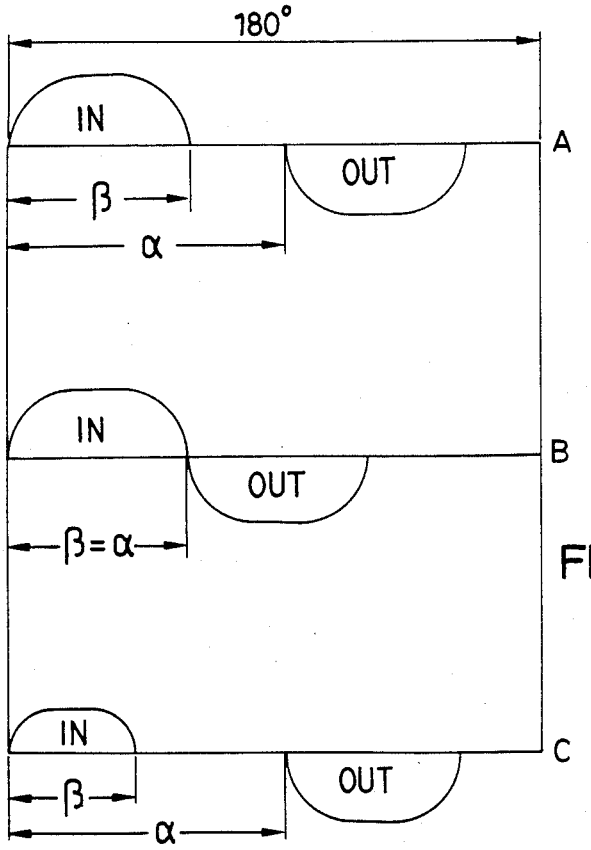
FIG. 3 is a schematic illustration showing the airflow patterning obtained by the pulse valve opening and closing.

FIG. 3 illustrates schematically the curve of the opening of the ports by the butterfly plates. With reference to the first portion of the diagram shown at A, the horizontal neutral line A illustrates a median pressure in the chamber 12 beneath the surface of the liquid As the butterfly valve plate 1 clears the edges of the ports 1 and 3, pressurized air will be admitted to the chamber 12 and the increase in air pressure will be shown by the curvature marked IN. As the edges of the butterfly plate pass the trailing edges of the ports 2 and 3, communication to the pressure dome 16 is cut off as illustrated by the end of the curve marked IN and the period of opening is illustrated by the dimension $\beta$. The dimension $\alpha$ shows the angle between the plates 1 and 4. When the edges of the plate 4 clear the ports 2' and 3', air is vented from the chamber 12 to atmosphere as indicated by the curved line marked OUT.

The curves at B in FIG. 3 illustrate an adjustment of the pulse valve so that the angle $\beta$ equals the angle $\alpha$. The curve marked IN will immediately be followed by the curve marked OUT with a period following the closing of both valves where the chamber 12 communicates neither with pressure nor with atmosphere.

The curves at C indicate adjustment of the pulse valve so that the angle $\beta$ is reduced as compared with its setting at A. As will be seen from the curves at C, the time of opening of the valve for pressurized air is shortened. The time lapse between the closing of the first valve to the opening of the second valve is increased, although the second valve opens at the same time as it did in the curves at A. The length of time of opening of the out valve remains the same as shown in A, B and C. The second out valve, however, will have a liner or bushing similar to that shown at 6 in FIG. 1 so that under certain conditions, the time of opening of the vent may be changed. As will be seen from FIG. 1, where the shaft 5 and the butterfly valve plate 1 rotate in a clockwise direction, the angle $\beta$ and the time of closing of the pressure valve can be shortened to achieve the effect of the curves at C by rotating the liner 6 in a counter-clockwise direction This brings the trailing lip of the liner further over the port 3 reducing the size of the opening and reducing the angle $\beta$. The time of opening can be delayed to be later as contrasted with that shown in curves A, B and C by rotating the liner 6 in a clockwise direction. The liner is either frictionally held or locked such as by a set screw arrangement in its adjusted rotational position within the housing. Thus, it will be seen that a relatively infinite number of settings can be obtained for controlling the time of the occurrence of opening and closing of the pressure ports or the atmosphere ports. Also, the total time that each port is open can be independently adjusted.

With reference to the curve indicated at A in FIG. 3, the angle $\alpha$ is 90° and the discharge and admission are symmetrical. The angle $\beta$ is established to be always less than 90°.

In the curve characterized at B, no time remains for expansion of air in the air chamber 12 and the discharge is opened immediately after the admission of the air.

Thus, it can be seen with a relatively simple construction, complete adjustment of control of the admission and release of air is obtainable. The effectiveness of the jigging or pulsations in the bed of liquid can be varied so as to be optimum. Variance will be required for various operating conditions such as speed of movement of the bed, type of minerals being handled, pressure of supply air and so forth. The valve structure particularly accommodates straight-through flow of pressurized air and the release of air so that with any timing and setting, the immediate response can be felt at the chamber beneath the surface of the liquid. All of these factors are important to an efficient effective operation of a jig.

Thus, it will be seen that there has been provided an improved valve and jig system which meets the objectives and advantages above set forth and with reduced cost of manufacture and improved reliability to reduce the times for shut-down and repair.

I claim as my invention:

1. A wet jig mechanism for handling coal or other minerals wherein a pulsed motion of a liquid mixture in a container is generated by pulsed compressed air delivered beneath the liquid, comprising in combination:

a rotary pulsing valve for alternately connecting said liquid container to compressed air or to atmosphere;

a housing for said valve having chambers with a first chamber having a first port for connecting to the liquid container and a second port for connecting to a source of compressed air;

said housing having a second chamber with a first port for connecting to the liquid container and a second port for connecting to atmosphere;

a butterfly valve plate in each of the chambers;

a common rotary shaft connecting said plates adapted to be driven in unidirectional rotation with said plates rotating with said shaft; and said plates being disposed on said shaft at a relative angle to respectively block communication between said first and second ports of each chamber during respective predetermined angular ranges of unidirectional rotational movement of the shaft and plates.

2. A wet jig mechanism for handling coal or other minerals wherein a pulsed motion of a liquid mixture is generated by a pulsed compressed air delivered beneath the liquid constructed in accordance with claim 1:

wherein said first and second ports of each of said chambers are in axial alignment for optimum direct flow of air to or from the container.

3. A wet jig mechanism for handling coal or other minerals wherein a pulsed motion of a liquid mixture is generated by a pulsed compressed air delivered beneath the liquid constructed in accordance with claim 1:

wherein the relative angle between said butterfly valve plates in said first and second chambers is variable.

4. A wet jig mechanism for handling coal or other minerals wherein a pulsed motion of a liquid mixture is generated by a pulsed compressed air delivered beneath the liquid constructed in accordance with claim 1:

wherein the opening of at least on of said ports is variable in size.

5. A wet jig mechanism for handling coal or other minerals wherein a pulsed motion of liquid mixture is generated by a pulsed compressed air delivered beneath the liquid constructed in accordance with claim 1:

wherein said chamber has an inner wall shaped to conform to the path of travel of an outer edge of the valve plate and a gap exists between said wall and said edge.

6. A wet jig mechanism for handling coal or other minerals wherein a pulsed motion of a liquid mixture in a container is generated by pulsed compressed air delivered beneath the liquid, comprising in combination:

a pulsing valve for alternately connecting said liquid container to compressed air or to atmosphere;

a housing for said valve housing a first valve chamber with a port to connect the liquid container to a source of compressed air and a second valve chamber having a port to connect said liquid container to atmosphere;

a rotatable butterfly valve plate in each chamber unidirectionally rotatable through 360° to respective positions to permit communication through said ports or to block communication;

each chamber having an inner wall arcuately shaped to conform to the path of movement of the edge of the valve plate therein;

a bushing in said housing having openings in substantial alignment with said ports; and means for accommodating rotational adjustment movement of said bushing to change the opening of said ports and correspondingly change the angle of said plate at which communication through said ports is permitted.

7. A wet jig mechanism for handling coal or other minerals wherein a pulsed motion of a liquid mixture is generated by a pulsed compressed air delivered beneath the liquid constructed in accordance with claim 6:

wherein said bushing is adjustable to permit communication between ports for a full 90° rotation of the plate or to accommodate communication over an angular position of less than 90°.

8. A wet jig mechanism for handling coal or other minerals comprising in combination:

a container for a liquid suspension or like materials;

a protected air opening beneath the surface of the liquid for alternately admitting compressed air or venting to atmosphere to cause a pulsation of the liquid in the container;

a pulse valve;

a housing for said valve having a first valve chamber having first and second ports, and a second valve chamber having first and second ports, said second ports of both valve chambers connected to said opening;

a source of compressed air connected to the first port of said chamber, said first port of said second chamber vented to atmosphere;

butterfly valve plates respectively disposed in each chamber and mounted on a common connecting rotatable shaft and unidirectionally rotatable through 360° to respective positions to alternately connect the compressed air to said opening or to vent said opening to atmosphere; and said plates positioned at a relative angle on said shaft so that the ports in said first chamber are in communication while the ports in said second chamber are blocked and the ports in said second chamber are in communication while the ports in said first chamber are blocked.

* * * * *